US010332372B2

(12) United States Patent
Skjellerup et al.

(10) Patent No.: US 10,332,372 B2
(45) Date of Patent: Jun. 25, 2019

(54) SECURITY SYSTEM AND SECURITY TAG ASSEMBLY

(71) Applicants: Braeburn Asset Holdings, LLC, Nassau (BS); ES Holding Dragør APS, Dragør (DK)

(72) Inventors: Johan Skjellerup, Delray Beach, FL (US); Eddie L. Stenild, Dragør (DK)

(73) Assignees: BRAEBURN ASSET HOLDINGS, LLC, Nassau (BS); ES HOLDING DRAGØR APS, Dragør (DK)

( * ) Notice: Subject to any disclaimer, the term of this patent is extended or adjusted under 35 U.S.C. 154(b) by 0 days.

(21) Appl. No.: 15/928,468

(22) Filed: Mar. 22, 2018

(65) Prior Publication Data

US 2018/0218583 A1 Aug. 2, 2018

Related U.S. Application Data

(62) Division of application No. 15/233,020, filed on Aug. 10, 2016, now Pat. No. 10,096,217.
(Continued)

(51) Int. Cl.
*G08B 13/24* (2006.01)
*E05B 73/00* (2006.01)

(52) U.S. Cl.
CPC ..... *G08B 13/2417* (2013.01); *E05B 73/0017* (2013.01); *E05B 73/0064* (2013.01);
(Continued)

(58) Field of Classification Search
CPC ..... E05B 73/0017; E05B 73/0064; G08B 13/2417; G08B 13/2434; G08B 13/2454; G08B 13/2457; G08B 13/246
(Continued)

(56) References Cited

U.S. PATENT DOCUMENTS

D205,049 S 6/1966 Brady
3,974,581 A 8/1976 Martens et al.
(Continued)

FOREIGN PATENT DOCUMENTS

BE 1004849 A7 2/1993
DE 20014860 U1 10/2000
(Continued)

*Primary Examiner* — Hirdepal Singh
(74) *Attorney, Agent, or Firm* — Malloy & Malloy, PL

(57) ABSTRACT

A security system and security tag assembly cooperatively operative to restrict unauthorized removal of an article from an area, wherein the security tag assembly is removably attached to the article and includes an RFID component/label configured to encode and retain data associated with the article to which it is attached. A deactivator assembly includes a read component structured to read the article data encoded in the security tag assembly, before or during removal of the tag assembly, wherein the read data is transmitted to a processor for display, storage and/or supplementary processing. One or more portable readers, not associated with the deactivator assembly or processor, are configured to access and display the article data for authorized article control. A review application may be downloaded on communication devices having short range technology and is configured to access the article data to obtain information relating thereto.

4 Claims, 7 Drawing Sheets

Related U.S. Application Data

(60) Provisional application No. 62/334,666, filed on May 11, 2016.

(52) U.S. Cl.
CPC ..... *G08B 13/246* (2013.01); *G08B 13/2434* (2013.01); *G08B 13/2454* (2013.01); *G08B 13/2457* (2013.01)

(58) Field of Classification Search
USPC ..... 340/572.8
See application file for complete search history.

(56) References Cited

U.S. PATENT DOCUMENTS

| | | | |
|---|---|---|---|
| 4,104,622 | A | 8/1978 | Van Niel |
| 4,299,870 | A | 11/1981 | Humble |
| 4,339,853 | A | 7/1982 | Lipschitz |
| 4,510,489 | A | 4/1985 | Anderson, III et al. |
| 4,523,356 | A | 6/1985 | Charlot, Jr. |
| 4,527,310 | A | 7/1985 | Vandebult |
| 4,590,461 | A | 5/1986 | Cooper |
| 4,603,453 | A | 8/1986 | Yokoyama |
| 4,651,136 | A | 3/1987 | Anderson et al. |
| 4,670,950 | A | 6/1987 | Wisecup et al. |
| 4,685,234 | A | 8/1987 | Anderson et al. |
| 4,774,503 | A | 9/1988 | Bussard |
| 4,884,833 | A | 12/1989 | Pedersen |
| 4,944,075 | A | 7/1990 | Hogan |
| 4,993,245 | A | 2/1991 | Ott |
| 5,031,287 | A | 7/1991 | Charlot, Jr. et al. |
| 5,054,172 | A | 10/1991 | Hogan et al. |
| 5,077,872 | A | 1/1992 | Guthammar |
| 5,088,165 | A | 2/1992 | Minasy et al. |
| 5,151,684 | A | 9/1992 | Johnsen |
| 5,205,024 | A | 4/1993 | Willard |
| 5,208,580 | A | 5/1993 | Crossfield |
| D343,134 | S | 1/1994 | Witzky |
| D343,135 | S | 1/1994 | Witzky |
| D344,033 | S | 2/1994 | Davidge |
| 5,347,262 | A | 9/1994 | Thurmond et al. |
| 5,367,289 | A | 11/1994 | Baro et al. |
| D354,924 | S | 1/1995 | Garner et al. |
| 5,426,419 | A | 6/1995 | Nguyen et al. |
| 5,497,639 | A | 3/1996 | Charlot, Jr. |
| 5,587,703 | A | 12/1996 | Dumont |
| 5,600,977 | A | 2/1997 | Piron |
| 5,613,384 | A | 3/1997 | Weber et al. |
| 5,748,089 | A | 5/1998 | Sizemore |
| 5,786,762 | A | 7/1998 | Liu |
| D410,400 | S | 6/1999 | Skjellerup |
| 5,912,622 | A | 6/1999 | Endo et al. |
| 5,942,978 | A | 8/1999 | Shafer |
| 5,942,987 | A | 8/1999 | Heinrich et al. |
| 5,955,951 | A | 9/1999 | Wischerop et al. |
| 6,023,951 | A | 2/2000 | Maurer et al. |
| 6,089,453 | A | 7/2000 | Kayser et al. |
| 6,281,800 | B1 | 8/2001 | Sizemore |
| 6,348,865 | B1 | 2/2002 | Siegel |
| D455,363 | S | 4/2002 | Fuss |
| 6,535,130 | B2 | 3/2003 | Nguyen et al. |
| 6,722,166 | B2 | 4/2004 | Skjellerup |
| 6,724,307 | B1 | 4/2004 | Siegel |
| 6,752,837 | B2 | 6/2004 | Karp |
| D494,488 | S | 8/2004 | Sayegh |
| 6,774,794 | B2 | 8/2004 | Zimmerman et al. |
| 7,073,236 | B2 | 7/2006 | Xue et al. |
| 7,075,440 | B2 | 7/2006 | Fabian et al. |
| 7,148,805 | B2 | 12/2006 | Hogan |
| 7,183,917 | B2 | 2/2007 | Piccoli et al. |
| 7,190,272 | B2 | 3/2007 | Yang et al. |
| 7,286,054 | B2 | 10/2007 | Skjellerup et al. |
| 7,347,068 | B2 | 3/2008 | Seidel |
| 7,382,256 | B2 | 6/2008 | Skjellerup et al. |
| 7,400,254 | B2 | 7/2008 | Yang et al. |
| 7,474,216 | B2 | 1/2009 | Skjellerup et al. |
| 7,474,222 | B2 | 1/2009 | Yang et al. |
| 7,523,630 | B2 | 4/2009 | Skjellerup |
| D603,739 | S | 11/2009 | Skjellerup |
| 7,652,574 | B2 | 1/2010 | Sayegh |
| 7,750,806 | B1 | 7/2010 | Skjellerup et al. |
| 7,817,041 | B2 | 10/2010 | Skjellerup et al. |
| 7,986,241 | B2 | 7/2011 | Copeland et al. |
| 8,051,686 | B2 | 11/2011 | Garner |
| 8,223,022 | B2 | 7/2012 | Skjellerup et al. |
| 8,242,910 | B2 | 8/2012 | Skjellerup et al. |
| 8,590,349 | B2 | 11/2013 | Skjellerup et al. |
| 10,096,217 | B2 | 10/2018 | Skjellerup et al. |
| 2002/0105424 | A1 | 8/2002 | Alicot et al. |
| 2003/0067397 | A1 | 4/2003 | Trimble |
| 2004/0070507 | A1 | 4/2004 | Campero |
| 2004/0231375 | A1 | 11/2004 | Skjellerup |
| 2004/0233042 | A1 | 11/2004 | Piccoli et al. |
| 2005/0030182 | A1 | 2/2005 | Hogan |
| 2005/0218218 | A1 | 10/2005 | Koster |
| 2006/0125643 | A1* | 6/2006 | Skjellerup ..... E05B 73/0017 340/572.9 |
| 2006/0139176 | A1 | 6/2006 | Skjellerup et al. |
| 2009/0229327 | A1* | 9/2009 | Valade, Jr. ..... E05B 73/0017 70/277 |
| 2012/0098664 | A1* | 4/2012 | Nordin ..... G06K 7/0008 340/572.1 |
| 2013/0199026 | A1* | 8/2013 | Mazoki ..... E05B 73/0017 29/601 |
| 2013/0247623 | A1 | 9/2013 | Skjellerup et al. |
| 2013/0278425 | A1 | 10/2013 | Cunningham et al. |
| 2014/0055249 | A1 | 2/2014 | Garner |
| 2014/0203936 | A1 | 7/2014 | Rasband et al. |
| 2014/0291409 | A1* | 10/2014 | Nitta ..... H01Q 1/38 235/492 |
| 2015/0029027 | A1 | 1/2015 | Marín Villamayor et al. |
| 2015/0048946 | A1* | 2/2015 | Luo |
| 2015/0243145 | A1 | 8/2015 | Nguyen |
| 2016/0260303 | A1* | 9/2016 | Strulovitch ..... G08B 13/2434 |
| 2017/0069185 | A1 | 3/2017 | Bergman |
| 2017/0132891 | A1* | 5/2017 | Norman ..... G08B 13/2434 |
| 2018/0218583 | A1 | 8/2018 | Skjellerup et al. |

FOREIGN PATENT DOCUMENTS

| | | | |
|---|---|---|---|
| DE | 202004008789 | U1 | 11/2004 |
| DE | 202004013895 | U1 | 12/2004 |
| EP | 0012923 | A1 | 7/1980 |
| EP | 0142748 | A1 | 5/1985 |
| EP | 0404329 | A1 | 12/1990 |
| EP | 0594324 | A2 | 4/1994 |
| EP | 1391574 | A2 | 2/2004 |
| EP | 1505551 | | 2/2005 |
| EP | 2791872 | | 10/2014 |
| JP | 2005-71143 | | 3/2005 |
| JP | 2006-249364 | | 9/2006 |
| WO | WO 2003/088006 | A2 | 10/2003 |
| WO | WO 2004/106674 | A1 | 12/2004 |
| WO | WO 2005/118991 | A1 | 12/2005 |

* cited by examiner

FIG. 1
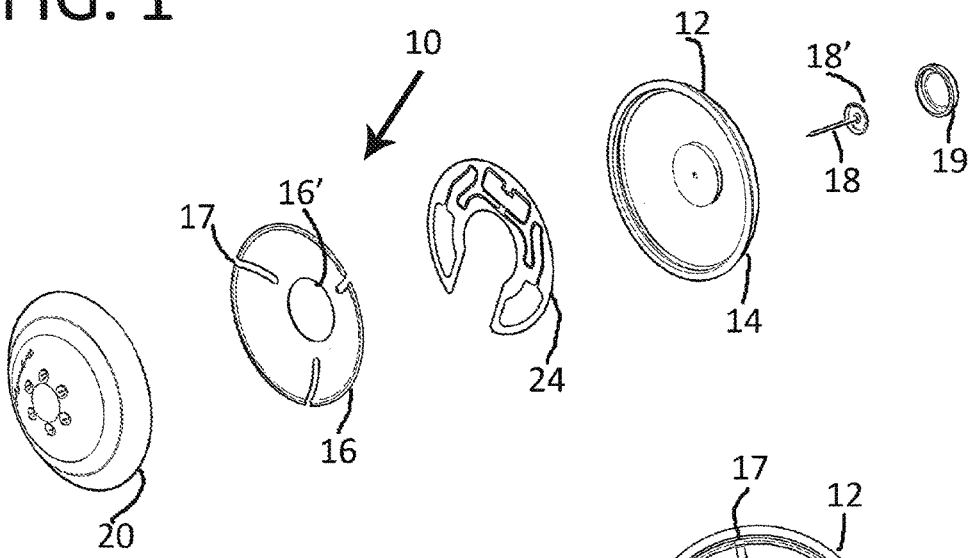
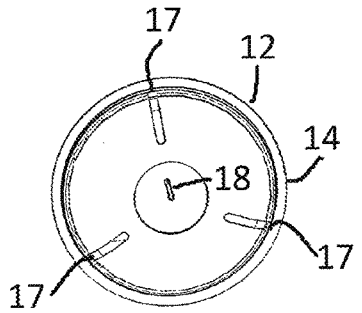
FIG. 2
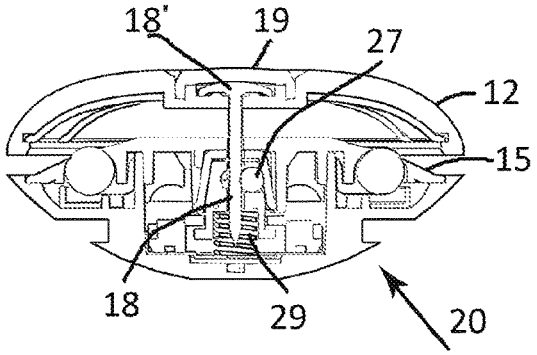
FIG. 3

FIG. 9
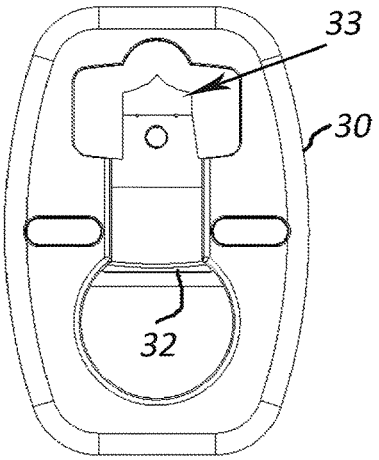
FIG. 9A
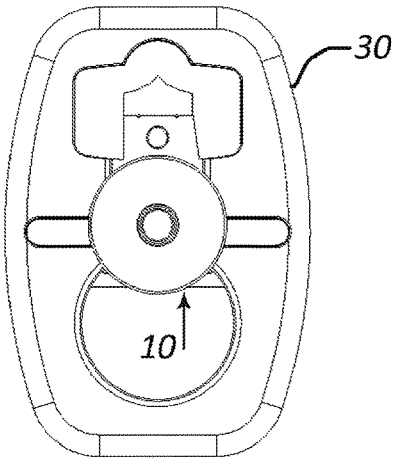
FIG. 9B
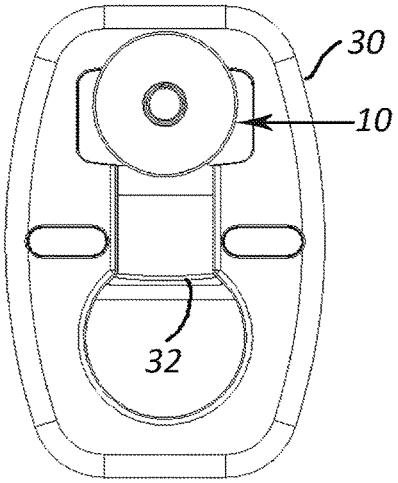
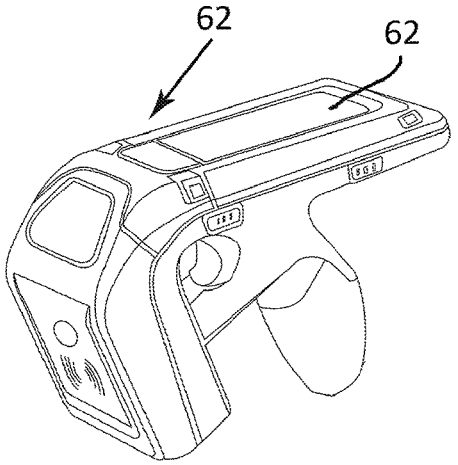
FIG. 13

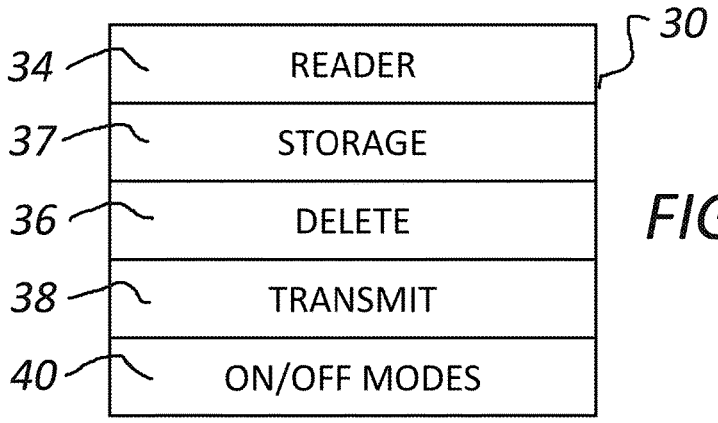
FIG. 10
FIG. 11
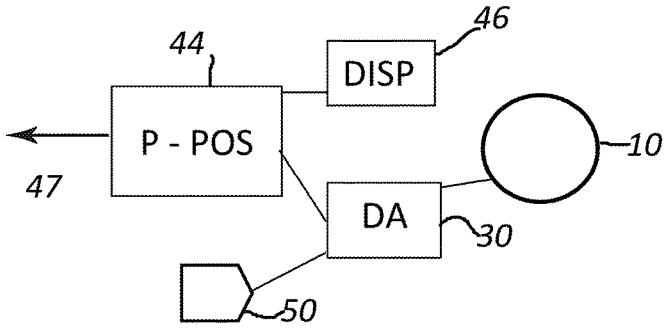
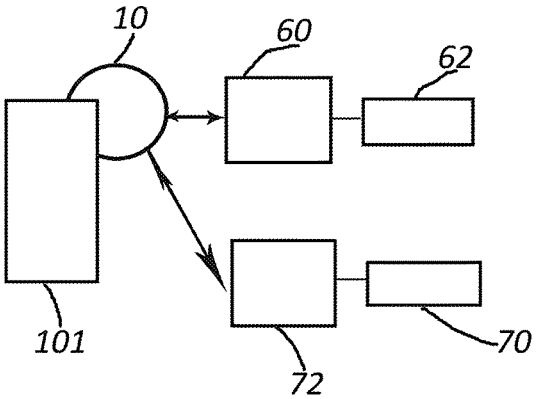
FIG. 12

SECURITY SYSTEM AND SECURITY TAG ASSEMBLY

CLAIM OF PRIORITY

The present application is a "divisional" patent application of U.S. patent application Ser. No. 15/233,020, filed on Aug. 10, 2016, which matured into U.S. Pat. No. 10,096,217 on Oct. 9, 2018, which is based on and a claim of priority is made under 35 U.S.C. Section 119(e) to U.S. Patent Application No. 62/334,666, filed on May 11, 2016, and which is incorporated herein by reference.

BACKGROUND OF THE INVENTION

Field of the Invention

This invention is directed to a security system and security tag assembly incorporating RFID technology, operative to restrict unauthorized removal of articles from an area. Article data is encoded and saved the RFID. A deactivator assembly includes a read component structured to read the encoded article data, wherein the read data is transmitted to a processor for display, storage and/or supplementary processing during or prior to removal of the security tag assembly. One or more portable readers are configured to access and display the article data for authorized personnel. A review application may be downloaded on communication devices having short range technology and is configured to access the article data to obtain information relating to article pricing, etc.

Description of the Related Art

Security or anti-theft tags are extensively used in the retail merchandising industry as well as numerous other areas of commerce. In typical fashion, such devices are attached to various types of merchandise in such a manner that that they are clearly obvious by one examining the merchandise. Common knowledge of the use and operation of such devices is believed to prevent or at least restrict the theft or other unauthorized removal of merchandise from the retail outlet or other area being monitored. More specifically, it is believed that such security tag devices serve as a deterrent to unauthorized removal, in that a potential thief will recognize that the merchandise will be "stained" or otherwise marked, thereby rendering the merchandise useless, upon forced removal of the security tag. Alternatively the tag may be structured to activate an alarm system as the merchandise, incorporating the tag thereon, passes through a monitoring station typically located at the exits to the retail establishment.

Due to the popularity of security or anti-theft devices of the type described above, numerous attempts have been made to design and structure a device which not only serves as a deterrent against theft, but which includes structural features intended to overcome any attempt to defeat the device which may be applied by an experienced thief. In addition, the structure of such security devices should be such as to be easily secured to and removed from different types of articles such that a device of substantially standard structure can be used to monitor and protect various types of merchandise.

As set forth above known security or anti-theft tags are intended to provide some indication which either renders the merchandise useless or alternatively signals an attempted unauthorized removal.

While popular, it is recognized that a significant number of the anti-theft tags currently being utilized include problems or disadvantages which render them less than totally efficient. More specifically, widespread knowledge of the structural features of such security tags allows unauthorized personnel to develop techniques which are specifically designed to remove the tag from the merchandise in a manner which defeats the aforementioned indicator structures. Therefore it is not uncommon for a skilled or experienced thief to develop tools or techniques to remove the merchandise from the area being monitored without damage to the stolen article or activation of an alarm or monitoring system.

Accordingly there is a recognized need in the security industry for a security system incorporating an anti-theft device preferably in the form of a relatively small security tag assembly which efficiently connects to various types of merchandise and which is specifically structured to overcome known techniques to remove or otherwise defeat such devices. Moreover, such protective structural features should be compatible with an efficient tag construction and configuration. Therefore, a security tag manufacture or provider who can effectively "customize" a proposed indicator assembly to include various "theft indicating" devices, electronic signaling devices or a combination thereof, while not requiring a restructuring or redesign of the entire tag assembly or the remaining, basic operable components associated therewith.

SUMMARY OF THE INVENTION

The present invention is directed to a security system operative to restrict unauthorized removal of articles from an area. Further, at least one, but more practically a plurality of security tag assemblies are utilized to implement the security system. Also, it will be noted that the security system and attendant security tag assembly is readily adaptable or use in a "retail environment". As such, the structural and operative features of the security system and security tag assembly may be described herein as being practiced in such a retail environment. However, it is noted that the security system and security tag assembly of the present invention in any of the preferred embodiments thereof is not limited to such a retail environment.

As practically applied and utilized, the security system of the present invention includes utilization of at least one, but more practically, a plurality of security tag assemblies. Each of the tag assemblies are removably secured to a different one of a plurality of articles within the secured area, such as the aforementioned retail store or the like. Moreover, each of the tag assemblies includes an RFID component, which as described in greater detail hereinafter, is preferably in the form of an RFID label.

Further, the RFID component is configured to have data relating to an article to which is attached, encoded or programmed therein. Such "article data" may vary but, by way of example only, may include information relating to pricing, inventory control, material, place and date of origin, warranties, treatment instructions, storage location or other information which may be of benefit to the seller, manufacture, customer, etc.

The security system of the present invention also comprises the use of at least one deactivator assembly. As utilized, the at least one deactivator assembly is used in operative association with a processor. As indicated above, in a conventional retail environment, the aforementioned processor may be or have the ability to function as a "checkout" device, cash register and/or point-of-sale (POS) facility and includes a monitor or display screen. In operative combination, the processor and a correspondingly disposed and operatively associated deactivator assembly may, in different preferred embodiments, serve to deactivate each security tag assembly attached to an article during the authorized "checkout" procedure.

As such, the deactivator assembly includes an RFID reader capable of accessing the article data contained on a given security tag assembly which relates to a specific article to which it is attached. As also explained hereinafter, various embodiments of the deactivator assembly may include storage facilities for retaining the downloaded article data being read by the deactivator assembly. Thereafter one or more additional preferred embodiments of the deactivator assembly include transmitter or generator capabilities. The data read by the deactivator assembly is "memorized" and stored for subsequent transmission to the processor. The processor, which in at least one embodiment of the present invention may be in the form of a "POS" terminal, cooperatively functions with the deactivator assembly to complete the checkout procedure at least to the extent of displaying pertinent portions of the article data such as pricing, etc. Further, the processor or POS terminal is capable of performing supplementary processing in addition to performing the checkout procedure. Such supplementary processing may relate to storage and/or transmission of certain portions of the article data for, by way of example only but not limited to, inventory control.

Additionally, the deactivator assembly may include on-off modes of operation which may serve as an additional security feature to prevent the unauthorized use of the deactivator assembly and/or processor. More specifically, authorized personnel associated with the area, retail establishment, etc. may carry or otherwise have immediate access to portable RFID devices, carried on their person. Such portable RFID devices could be in the form of labels, plastic tags, or other RFID operative devices capable of accomplishing the "off-mode" and "on-mode" of the deactivator assembly serving to lock and unlock its use or operability. In use, the portable RFID device carried by authorized personnel will be passed over an RFID antenna associated with the deactivator assembly serving to unlock the deactivator assembly, at least for a preset or preprogrammed time period. Accordingly, when the deactivator assembly is not used within the preset or preprogrammed period of time, it will automatically turn off or be in a locked state of operation. As a result, the next authorized individual intending to complete a checkout procedure will again have to expose or access that individual's portable RFID device to the antenna of the deactivator in order to unlock the deactivator and render it operable. Therefore, the authorized portable RFID devices are structured to place the deactivator assembly and/or processor/POS terminal in an "on-mode" for the predetermined or preset period of time and subsequently upon expiration thereof the deactivator assembly will automatically be disposed in an "off-mode". In the "on-mode", the deactivator assembly and/or processor is capable of performing the checkout procedure and/or the deactivation of the RFID component associated with a given security tag assembly, in an intended manner. However, in the "off-mode", operation of the deactivator assembly is restricted to the extent that a security tag assembly cannot be "deactivated" and/or removed. This will prevent customers or any unauthorized personnel from utilizing the deactivator assembly to deactivate and/or remove a security tag assembly, facilitate its detachment from the article and/or otherwise facilitate the unauthorized removal of the article from the secured area. It is also noted that the plurality of security tag assemblies associated with the security system of the present invention may also be equipped with electronic article surveillance (EAS) of conventional design and operation, to facilitate monitoring and prevention of articles passing through monitoring stations located at exit ways of the secured area. In addition to or instead of the EAS surveillance the security tag assembly may include ink cartridges.

Additional operative and structural features associated with the security system of the present invention is the ability of authorized personnel to periodically or on a predetermined basis check the status of articles and/or article data by wirelessly monitoring any of the security tag assemblies. More specifically, authorized personnel may include portable RFID readers which may or may not be directly associated with the reading devices operative to determine the aforementioned on-off modes of the deactivator assembly. More specifically, utilizing the portable, wireless RFID readers authorized personnel may access the article data of any given security tag assembly. Such article data is read and displayed on the portable RFID reader to facilitate an update of the article data such as pricing review or changing or as a method of reviewing the accuracy of such article data.

Yet additional features of the security system of the present invention include a review application configured to access article data encoded on the RFID component associated with the different security tag assemblies. As such, the review application is configured to be downloaded on and operative with a communication device carried by customers or other non-employees visiting the secured area. Such a communication device may be a smart phone or the like having short range communication facilities such as, but not limited to Bluetooth, NFC, etc. In use, a customer may thereby position his or her smart phone, or other device, in relatively close proximity to a given security tag. This will result in at least some of the article data being accessed and displayed on the display function of the smart phone. The customer may thereby be informed of pricing and/or other information relating to the purchase or features associated with the article intended to be purchased.

Each of the possibly large number of security tag assembly used to implement the security system of the present invention may vary in construction, function and purpose dependent, at least in part, on the embodiment utilized. Accordingly one or more preferred embodiments of the tag assembly include a tag member including a housing, in which the RFID component is mounted. More specifically, the RFID component may include an RFID label which is secured to the inner surface of the housing in a manner which conforms the RFID label to the configuration or shape of the inner surface. An attachment structure in the form of an elongated connector pin is secured to the housing by passing there through and through interior portions of the integrated circuit, which may at least partially define the structure of the RFID label. Conformance of the RFID label to the inner surface of the housing may be accomplished by producing the IC on a sheet of flexible material.

A cover member is disposed in overlying relation to the RFID label and in covering relation to at least a portion and/or majority of the inner surface of the housing. The cover member serves to retain and accurately position the RFID label in its intended orientation within the housing. Further, structural features associated with the cover member may facilitate its securement to the interior of the housing and/or to the RFID label itself.

Each of at least one embodiment of the plurality of security tag assemblies includes a base removably attached to the tag member by virtue of removable interconnection with the aforementioned connector pin. As such, the base includes a locking mechanism which may differ in structure and operation but which serves to securely engage the connector pin so as to maintain the tag member and the base connected to one another and in retaining or capturing relation to the article to which the tag assembly is secured. Therefore, in use the tag member and the base are initially separated. Securement to a given article is accomplished by passing the connector pin through the article and into secured engagement with the locking assembly associated with the base. The structure of the base, specifically including the locking assembly may also be adapted for deactivation or release of the connector pin by operative engagement or proximity scanning of the security tag assembly relative to the aforementioned deactivator assembly.

Accordingly, variations of the security system and security tag assembly of the various embodiments of the present invention provide a unique and effective protection of an area to be secured, in terms of preventing unauthorized removal of articles from the secured area.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 1 is a perspective view in exploded form of one embodiment of a security tag assembly used in the security system of the present invention.

FIG. 2 is a perspective interior view of a tag component in at least partially assembled form of the embodiment of FIG. 1.

FIG. 3 is a transverse interior sectional view of the embodiment of FIG. 1 in assembled form.

FIG. 9 is a front plan view of a deactivator assembly incorporated in at least one preferred embodiment of the security system of the present invention.

FIG. 9A is a front plan view of the embodiment of FIG. 9 in operative relation to a security tag assembly during a checkout procedure.

FIG. 9B is a front plan view of the embodiment of FIG. 9 in operative relation to a security tag assembly for purposes of deactivation and removal from an article.

FIG. 10 is a schematic representation of at least one preferred embodiment the deactivator assembly of the present invention.

FIG. 11 is a schematic representation of one embodiment and/or implementation of the security system of the present invention.

FIG. 12 is a schematic representation of yet another embodiment and/or implementation of the security system of the present invention.

FIG. 13 is a perspective view of a portable reader assembly operative to review article data associated with each of a possible plurality of security tag assemblies.

Like reference numerals refer to like parts throughout the several views of the drawings.

DETAILED DESCRIPTION OF THE PREFERRED EMBODIMENT

Figure 4:
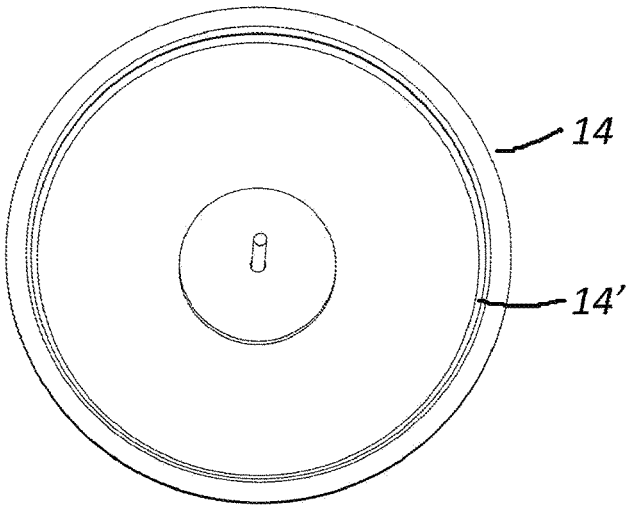
FIG. 4 is an interior perspective view of a housing of the tag component of the embodiment of FIGS. 1-2.

The present invention is directed to a security system, generally indicated as 100 in FIGS. 10-11, operative to restrict unauthorized removal of articles 101 from an area. Further, at least one, but more practically a plurality of security tag assemblies 10, represented in detail in FIGS. 1-8, are utilized to implement the security system 100.

For purposes of clarity, the structural and operational features of the security tag assembly 10 will be described herein and subsequently its use in the system 100. With primary reference to FIGS. 1-3, the security 10 comprises a tag member 12 including a tag housing 14 and a cover member 16. FIG. 2 represents the housing 14, connector pin 18 and cover member 16 in an assembled orientation, but not connected to a base 20 of the security tag assembly 10. More specifically, the tag member 12 includes an RFID component generally indicated as 24 and represented in detail and in at least partially assembled form in FIGS. 5-6. The RFID component 24 is preferably in the form of an RFID label which may include an integrated circuit (IC) mounted on a flexible material film or the like 26. Further, the RFID component/label 24 includes a substantially "open configuration" to facilitate its attachment to the interior surface 14' of the housing 14 in cooperation with the placement of the connecting pin 18.

When so disposed within the housing 14, the RFID component or label 24 is disposed in overlying relation to the inner surface 14' and due to the flexibility of the film 26 on which it is disposed, the RFID component/label 24 substantially conforms to at least a portion of the shape of the interior surface 14'. The connector pin 18 has a sufficiently elongated configuration to extend outwardly from the interior of the housing 14 and be connected to the locking assembly 27 associated with the base 20.

The locking assembly 27 may be structurally and operationally similar and/or equivalent to that disclosed in U.S. Pat. No. 8,590,034, to the inventor herein. As such, the locking assembly 27 may include a plurality of balls or like locking members, as described in the above noted U.S. Patent, disposed in a secured, retained orientation by biasing spring 29. Authorized release of the security tag assembly 10 can be accomplished by utilization of an externally applied detachment assembly of the type described in above referenced patent. More specifically, the external detachment assembly includes at least one or more detachment members (not shown herein) which pass through appropriately disposed and aligned apertures 20' in the base 20 and into a detaching engagement with portions of the locking assembly 27. As a result the tag member 12 and the connecting pin 18 are separable from the base 20 and the locking assembly 27.

Figure 5:
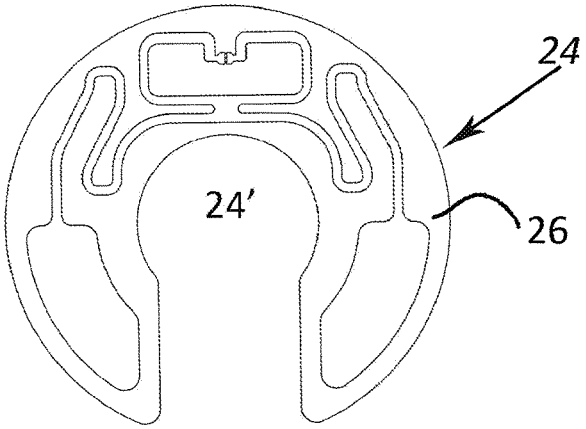
FIG. 5 is a plan view of an RFID component in the form of an RFID label as incorporated in the embodiment of FIGS. 1-3.
Figure 6:
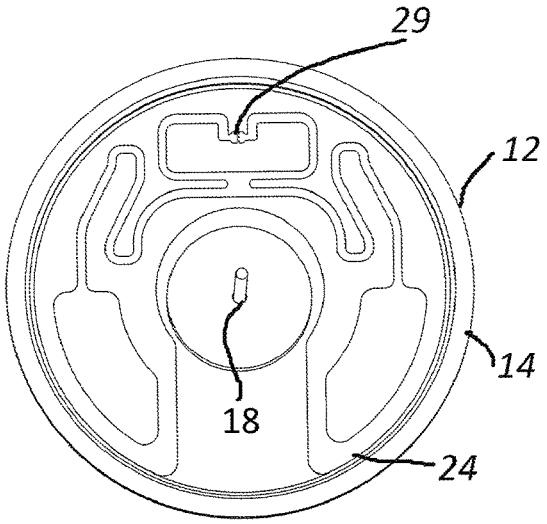
FIG. 6 is an interior perspective view of the structural components of FIGS. 4 and 5 in at least partially assembled form.

With primary reference to FIGS. 4-6, the pin is attached to the housing 14 by passing there through from an exterior and as represented in both FIGS. 1 and 3. More specifically, a protective cap or plug 19 may be disposed in covering relation to the pinhead 18' and be secured to the exterior portion of the housing 14 as clearly represented in FIG. 3. The pin 18 passes through the housing 14 generally at a center portion thereof. Also, as represented in FIG. 6 the pin 18 will also pass through an open portion 24' of the RFID label 24. This will allow placement of the metallic material pin 18 in sufficiently spaced relation to an antenna or other portions of the RFID label 24 to reduce electrical and/or operational interference there between.

Figure 7:
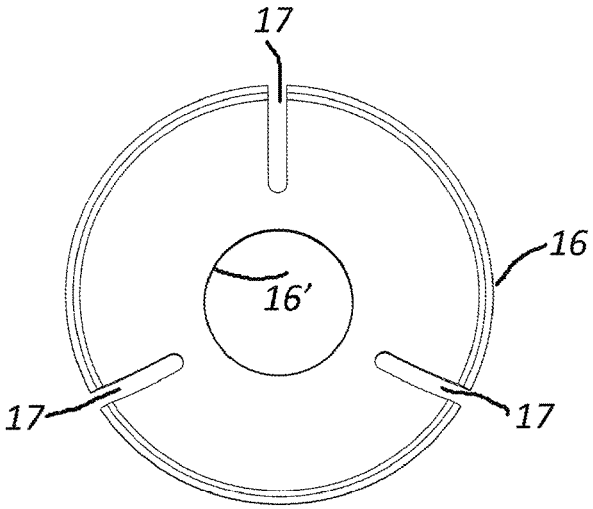
FIG. 7 is an interior perspective view of a cover member of the embodiment of the security tag assembly as represented in FIGS. 2-3.
Figure 8:
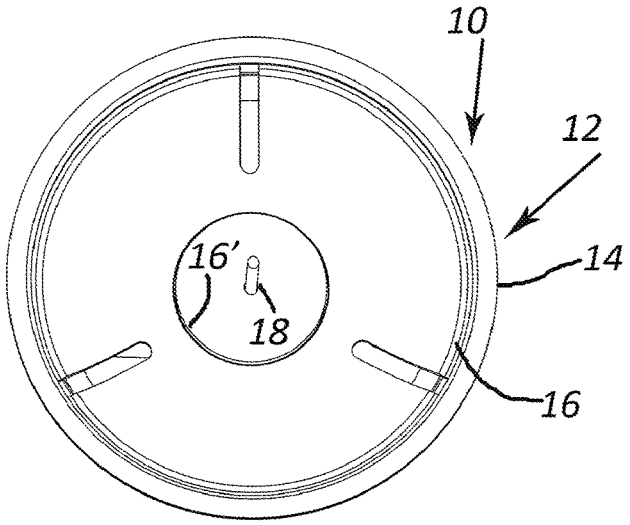
FIG. 8 is an interior perspective view of the structural components, as represented in FIGS. 4-7, of the security tag assembly of the embodiment of FIG. 1.

Additional features of the tag member 12 includes the aforementioned cover member 16 being disposed in overlying, covering relation to the RFID component and label 24 and in covering relation to a portion and/or majority of the inner surface 14' of the housing 14, as represented in greater detail in FIGS. 6-8. In addition, structural features associated with the cover member 16 include at least one but preferably a plurality of elongated channels or slots 17. The one or more slots 17 are used to provide an efficient and effective "snap-fit" or like attachment to the RFID component/label 24, as represented in FIG. 6. Accordingly, when assembled, as represented in FIG. 8, the cover member 16 will be disposed in overlying relation to the RFID label/component 24 and in covering and overlying relation to at least a portion of the inner surface 14' of the housing 14. Further, a central opening 16' is disposed in the cover member 16 and is in general alignment with the connecting pin 18 thereby allowing passage of the connecting pin 18 there through into secure relation with the base 20 and locking assembly 27.

Yet additional features associated with the security tag assembly 10 may include a freely rotational connection between the housing 20 of the tag member 12 and the base 20. This will restrict the ability to "unscrew" and/or otherwise detach the housing 14 from the base 14, such as by unauthorized personnel. Also, additional strength may be added to the security tag assembly 10 by forming at least portions thereof from a zinc material in order to enhance the strength thereof while concurrently reducing the possibility of electrical and/or magnetic interference between operative portions thereof and a deactivator assembly generally indicated as 30 in FIGS. 9-10.

Figure 9C:
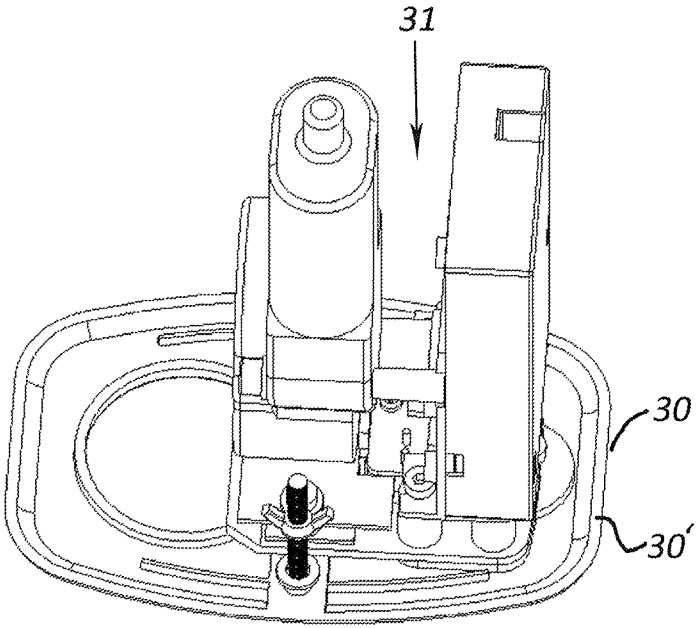
FIG. 9C is an interior/rear view of the deactivator assembly of the embodiment of FIGS. 9-9B and electronics associated with the operation thereof.

For purposes of clarity, FIGS. 9-9C represent the deactivator assembly 30 independently of its typically intended use with a point of sale (POS) and/or processor 44, as described in greater detail hereinafter in FIG. 10. As such, the deactivator assembly 30 includes a deactivating portion 32, operative to effectively deactivate the security assembly 10, as represented in FIG. 9A during a relatively close proximity scan and/or placement of the security tag assembly 10 by the deactivator assembly 30. As such, the deactivator assembly 30 includes the aforementioned deactivating portion/reader 32 as well as an assembly 33 disposed and structured to facilitate disconnection of the security assembly 10 from the article 101 to which it was originally attached. FIG. 9C is a rear or interior side 30' of the deactivator assembly 30 including electronics generally indicated as 31, associated with the operation thereof.

As used and as represented in FIG. 9A, the security tag assembly 10 is disposed in direct reading access or proximity to the reading and deactivating portion 32. After the article data has been read and the security tag assembly 10 is ready for disconnection or separation from the article 101, it is disposed into the alignment with the disconnection assembly portion 33. At this location, portions of the security tag assembly 10 are separated from one another to facilitate removal of the article 101 therefrom. Such disconnection and/or separation may be accomplished in the manner described in the above noted reference to the inventor herein.

It is further noted that once deactivated and disconnected from the article 101, the activation assembly 30 may be reprogrammed for reuse with different article data. As such the RFID label 34 remains active/powered to facilitate such reprogramming and reuse.

With primary reference to FIG. 10, the deactivator assembly 30, dependent on the preferred embodiment implemented into the system 100, includes a plurality of operative features. Such operative features include a reader function 34, a delete function 36, a storage function 37 a transmit function 38 and an on-off modes function 40. The various functions 34-40 of the deactivator assembly 30 may be operable independently or collectively dependent, at least in part, upon the embodiment of the deactivator assembly 30 utilized and the intended and/or desired implementation of various aspects of the security system 100.

More specifically, and as collectively represented in FIGS. 10-12, the deactivator assembly 30 is operative and may be physically associated with a processor/POS terminal 44. As indicated above, the processor 44 may be, but is not limited to, a POS terminal of the type utilized in a retail environment and includes "checkout" procedures facilitating the purchase or otherwise authorized removal of an article 101 from the secured area. Further, the processor/POS terminal 44 includes a monitor or display screen 46 and also includes memory and or transmission capabilities capable of storing "article data" downloaded from each of the plurality of security tag assemblies 10. However, integration of the processor and POS terminal 44 results in processing of the "article data" directly therein and/or thereby. As set forth above, the RFID label/component 24 is configured to have data relating to an article, to which it is attached, encoded or programmed therein. Such "article data" may vary but, by way of example only, may include information relating to pricing, inventory control, material, place and date of origin, warranties, treatment instructions, storage location or other information which may be of benefit to the seller, manufacture, customer, etc.

Moreover, the memory and transmission facilities associated with the processor/POS terminal 44 may facilitate the transmission, as at 47, of memorized or retained article data received from each of the one or more security tag assemblies 10 to supplementary processing facilities such as, but not limited to, inventory control or the like. In the alternative, such "supplementary processing" may take place in the processing facilities associated with the processor/POS terminal 44. In addition, when a security tag assembly 10, attached to an article 101 is ready for checkout or authorized removal, a proximity scan thereof is accomplished by the deactivator assembly 30 as also represented in FIG. 9A. Dependent upon the different operational and structural embodiments of the deactivator assembly 30 being utilized, there may be only a reading of the article data by the reader function 32, 34 of the deactivator assembly 30, from the security tag assembly 10 wherein such read data is visually available and accessed on the display 46. In such an embodiment, the security tag assembly 10 may not necessarily be removed from the article 101 and is read and/or scanned for purposes of review of the article data for purposes of pricing, inventory, etc.

In yet another embodiment the deactivator assembly 30 utilizes additional ones of the operative features to the extent that the encoded data within the security tag assembly 10 is read, by reader function 32, 34 and is stored by reader function 37 and is substantially concurrently deleted from the security tag assembly 10 by the delete function 36. Thereafter, locking assembly 27 of the security tag assembly 10 acted upon as set forth above and as represented in FIG. 9B thereby permitting a detachment of the tag member 12 from the base 20 and a removal of the security tag assembly 10 from the article 101 to which it was originally attached. Thereafter or concurrently there with the read article data from these security tag assembly 10, being stored, as at 37 may be transmitted by transmission function 38 to the memory/database of the processor/POS terminal 44 wherein such stored data is visually accessible on display 46. As set forth above, the stored and retained article data may be transmitted for additional or supplementary processing or such supplementary processing may occur utilizing the processor facilities integrated in the processor/POS terminal 44. Such supplementary processing may include, but is not limited to, inventory control, etc. As also noted herein, once read and stored by the deactivator assembly 30 and/or processor 44, the article data is deleted from the security tag assembly 10. As also set forth above, the security tag assembly 10 and more specifically the RFID label 24 remains active/powered and is thereby capable for reuse by being reprogrammed or encoded again with different article data when attached to a different article.

Additionally, the deactivator assembly 30 may include on-off modes as schematically represented by the on/off mode function 40 in FIG. 10. In operation, the on-off mode of the deactivator assembly 30 may serve as an additional security feature to prevent the unauthorized use of the deactivator assembly 30 and/or processor 44. More specifically, authorized personnel associated with the area, retail establishment, etc. may carry and/or have access to portable RFID reading devices 50 as schematically represented in FIG. 11.

Such portable RFID devices 50 could be in the form of labels, plastic tags, or other RFID operative devices capable of accomplishing the "off-mode" and "on-mode" of the deactivator assembly by serving to lock and unlock its use or operability. More specifically the portable RFID device 50, carried by authorized personnel, will be passed over and/or brought into a predetermined, operative proximity to an RFID antenna associated with the deactivator assembly 30. As a result, assuming that the deactivator assembly 30 has not been used for a predetermined or preset period of time, it will automatically assume its "off-mode" by being locked. In order to proceed with a checkout procedure, authorized personnel, in the possession of or having access to the portable reading device 50, access the antenna of the deactivator assembly 30 with the portable reading device 50 as set forth above. This will unlock or place the deactivator assembly 30 in the "on-mode" at least for a preset or preprogrammed time period, as set forth above. Therefore, when the deactivator assembly is not used for the preset or preprogrammed period of time, it will automatically turn off or be disposed in a locked state of operation, in the "off-mode". As a result, the next authorized individual intending to complete a checkout procedure will again have to expose or access that individual's portable RFID device 50 to the antenna of the deactivator assembly 30 in order to unlock the deactivator assembly 30 and render it operable in the "on-mode".

Therefore, the authorized portable RFID devices 50 are structured to place the deactivator assembly and/or processor/POS terminal in an "on-mode" for the predetermined or preset period of time and subsequently upon expiration thereof the deactivator assembly 30 will automatically be disposed in an "off-mode". In the "on-mode", the deactivator assembly 30 and/or processor/POS terminal 44 is capable of performing the checkout procedure and/or the deactivation of the RFID component associated with a given security tag assembly 10, in an intended manner. However, in the "off-mode", operation of the deactivator assembly 30 is restricted to the extent that a security tag assembly 10 cannot be "deactivated" and/or removed until the deactivator assembly 30 is again placed in the "on-mode" such as through utilization by authorized personnel of the portable RFID device 50. This will prevent customers or any unauthorized personnel from utilizing the deactivator assembly 30 to deactivate and/or remove a security tag assembly, facilitate its detachment from the article 101 and/or otherwise facilitate the unauthorized removal of the article 101 from the secured area.

In a practical application, the portable RFID reading devices 50 may be in the form of labels, plastic tags, or variety of other structures having RFID capabilities and which may be carried on the person of authorized personnel. In use, an authorized individual may wirelessly access the deactivator assembly 30 and/or processor to complete a checkout procedure or article data review. This will prevent customers or any unauthorized personnel from utilizing the deactivator assembly 30 to deactivate a security tag assembly, facilitate its detachment from the article 101 and/or otherwise facilitate the unauthorized removal of the article from the secured area. It is also noted that the plurality of security tag assemblies 10 associated with the security system 100 of the present invention may also be equipped with electronic article surveillance (EAS) of conventional design and operation, to facilitate monitoring and prevention of articles passing through monitoring stations located at exit ways of the secured area, without removal and/or deactivation of the security tag assembly 10. As an alternative and or in addition to EAS surveillance the security tag assembly 10 may include ink cartridges as at 15 in FIG. 3

Additional operative and structural features associated with the security system of the present invention is the ability of authorized personnel to periodically or on a predetermined basis check the status of articles 101 and/or article data by wirelessly monitoring any of the security tag assemblies 10. More specifically, authorized personnel may include portable RFID readers 60, as represented in FIG. 13 and schematically in FIG. 12. It is emphasized that the RFID reader 60 are to be distinguishable from the portable RFID devices 50 carried by authorized personnel which, set forth above are operative to determine the "on-off mode' of the deactivator assembly 30. More specifically, RFID readers 60 are preferably operative on a wireless basis and are portable. As represented in FIG. 13, the RFID readers 60 may include display facilities 62 authorized personnel may access the article data of any given security tag assembly 10. Such article data is read and displayed, as at 62 on the portable RFID reader 60 to facilitate an update of the article data, such as pricing review or changing or as a method of reviewing the accuracy of such article data.

Yet additional features of the security system 100 of the present invention includes a review application configured to access article data encoded on the RFID component 24 associated with the different security tag assemblies 10. As such, the review application 70 is configured to be downloaded on and operative with a communication device 72 carried by customers or other non-employees visiting the secured area. Such a communication device 72 may be a smart phone or the like having short range communication facilities such as, but not limited to Bluetooth, NFC, etc. In use, a customer may thereby position his or her smart phone 72, or other device, in relatively close proximity to a given security tag. This will result in at least some of the article data being accessed and displayed on the display function of the smart phone 72. The customer may thereby be informed of pricing and/or other information relating to the purchase or features associated with the article intended to be purchased.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A security system to restrict unauthorized removal of an article from an area, said security system comprising:

a security tag assembly comprising a tag component structured for attachment to the article and including a housing;

an RFID component comprising an RFID label secured in overlying, substantially conforming relation to an interior surface of said housing;

said tag component including a cover member disposed in overlying relation to said RFID label and in at least partially covering relation to said interior surface of said housing;

said security tag assembly further comprising a base removably connectable to said housing, each of said base and said housing cooperatively structured for removable attachment to the article when connected to one another;

an elongated pin secured to said housing and extending outwardly from said interior surface into a connectable disposition with said base; and said pin extending through said cover into said connectable disposition with said RFID label.

2. The security system as recited in claim 1 wherein said pin extends through said RFID label in predetermined spaced relation thereto, said predetermined spaced relation being sufficient to reduce electrical interference between said pin and said RFID label.

3. The security system is recited in claim 1 wherein said RFID label comprises a flexible material sheet including an integrated circuit disposed thereon.

4. A security system to restrict unauthorized removal of an article from an area, said security system comprising:

a security tag assembly comprising a tag component structured for attachment to the article and including a housing;

an RFID component comprising an RFID label secured in overlying, substantially conforming relation to an interior surface of said housing;

said tag component including a cover member disposed in overlying relation to said RFID label and in at least partially covering relation to said interior surface of said housing;

said security tag assembly further comprising a base removably connectable to said housing, each of said base and said housing cooperatively structured for removable attachment to the article when connected to one another;

an elongated pin secured to said housing and extending outwardly from said interior surface into a connectable disposition with said base; and said pin extending through said RFID label in predetermined spaced relation thereto, said predetermined spaced relation being sufficient to reduce electrical interference between said pin and said RFID label.

* * * * *